US012263372B1

(12) United States Patent
Rice

(10) Patent No.: US 12,263,372 B1
(45) Date of Patent: Apr. 1, 2025

(54) INTERCHANGEABLE FITNESS APPARATUS

(71) Applicant: Jason Rice, Elgin, IL (US)

(72) Inventor: Jason Rice, Elgin, IL (US)

( * ) Notice: Subject to any disclaimer, the term of this patent is extended or adjusted under 35 U.S.C. 154(b) by 195 days.

(21) Appl. No.: 18/122,604

(22) Filed: Mar. 16, 2023

Related U.S. Application Data

(60) Provisional application No. 63/320,662, filed on Mar. 16, 2022.

(51) Int. Cl.

| | |
|---|---|
| ***A63B 22/20*** | (2006.01) |
| ***A63B 15/00*** | (2006.01) |
| ***A63B 21/00*** | (2006.01) |
| ***A63B 21/002*** | (2006.01) |
| ***A63B 21/06*** | (2006.01) |
| ***A63B 23/02*** | (2006.01) |

(52) U.S. Cl.
CPC ..... *A63B 22/20* (2013.01); *A63B 15/00* (2013.01); *A63B 21/002* (2013.01); *A63B 21/0618* (2013.01); *A63B 21/4035* (2015.10); *A63B 23/0205* (2013.01)

(58) Field of Classification Search
CPC ..... A63B 21/0004; A63B 21/00061; A63B 21/002; A63B 21/0601; A63B 21/0608; A63B 21/0615; A63B 21/0618; A63B 21/22; A63B 21/4035; A63B 22/00; A63B 22/201
See application file for complete search history.

(56) References Cited

U.S. PATENT DOCUMENTS

| | | | | |
|---|---|---|---|---|
| 4,634,121 A * | 1/1987 | Sasaki | A63B 15/00 482/109 |
| 6,190,292 B1 * | 2/2001 | Panes | A63B 21/06 482/109 |
| 8,870,719 B2 * | 10/2014 | Johnson | A63B 21/072 482/44 |
| 2017/0266478 A1 * | 9/2017 | Black | A63B 22/20 |

* cited by examiner

*Primary Examiner* — Zachary T Moore
(74) *Attorney, Agent, or Firm* — UNDERWOOD & ASSOCIATES, LLC

(57) ABSTRACT

An exercise apparatus is disclosed. The exercise apparatus includes an elongate bar, a rolling member including an outer surface and a centrally-located axial aperture that extends through the rolling member, and at least one pair of apertures disposed within the elongate bar, each aperture of the pair of apertures being configured to receive a locking pin. A distance between the at least one pair of apertures is slightly greater than a length of the centrally-located axial aperture, and at least one pair of apertures is disposed entirely on a right or left side of a midpoint of the elongate bar.

18 Claims, 2 Drawing Sheets

INTERCHANGEABLE FITNESS APPARATUS

REFERENCE TO RELATED APPLICATIONS

This application claims priority to and the benefit under 35 USC § 119 (e) of U.S. Provisional Patent Application No. 63/320,662, filed on Mar. 16, 2022, the contents of which are incorporated by reference in their entirety as if fully set forth herein.

TECHNICAL FIELD

This disclosure relates to systems and methods for an interchangeable fitness apparatus. In particular, this disclosure relates to a fitness apparatus that can be transformed between a balancing push-up bar, a plank bar, an abdominal wheel and a mace-like fitness club.

BACKGROUND

Core fitness refers to the strength and conditioning of the muscles in the core of the body, including the abs, obliques, lower back, and hips. A strong core can improve overall stability, balance, and posture, as well as reduce the risk of injury in everyday activities and athletic endeavors.

There are a variety of exercises and techniques used to improve core fitness, including traditional exercises such as crunches and planks, as well as more dynamic movements such as kettlebell swings and medicine ball throws. Additionally, activities such as yoga and Pilates can also help to improve core strength and flexibility.

Benefits of improving core fitness can include increased athletic performance, better posture and balance, reduced back pain, and improved overall physical health. However, it is important to note that core fitness is just one aspect of overall fitness and should be combined with a balanced diet and regular cardiovascular exercise for optimal health and wellness.

Core workout appliances are tools and equipment designed to target and strengthen the muscles in the core of the body. These appliances can be used in a variety of settings, including gyms, fitness studios, and even at home. Some of the most popular core workout appliances include stability balls, ab rollers, and resistance bands. Stability balls are large, inflatable balls that can be used for a variety of exercises, such as planks, crunches, and bridges, to challenge the core muscles and improve balance and stability. Ab rollers are small devices that can be used to perform rollouts and other exercises to target the abs and obliques. Resistance bands are versatile tools that can be used for a range of exercises, such as standing twists and seated rows, to target the core muscles from different angles and intensities.

Other core workout appliances include medicine balls, kettlebells, and foam rollers. Medicine balls can be used for a variety of exercises, such as wood chops and Russian twists, to engage the core muscles while also improving overall strength and power. Kettlebells are weights with a handle, which can be used for exercises such as swings and Turkish get-ups to build core strength and endurance. Foam rollers are cylindrical pieces of foam that can be used for self-massage and myofascial release to alleviate muscle tension and improve flexibility.

A mace is a fitness tool that has become increasingly popular in core training. It is a long metal rod with a weight at one end that is swung in a variety of movements to work different muscle groups. The mace is used in core training to improve balance, stability, and strength.

When performing mace exercises, the core muscles must engage to stabilize the body and control the movement of the mace. This can help to strengthen the abdominal muscles, lower back muscles, and hip muscles, which are all essential for good core strength. One popular mace exercise for core training is the 360, where the mace is swung in a circular motion around the body. This exercise targets the entire core, including the obliques, and requires coordination and balance to perform correctly.

Other mace exercises that can help to strengthen the core include the shovel, where the mace is swung from one side of the body to the other, and the barbarian squat, where the mace is held overhead while squatting. Incorporating a mace into core training can add variety to a workout routine and help to improve core strength, stability, and balance.

Core workout appliances can be a valuable addition to any fitness routine, providing a range of options to challenge and strengthen the muscles in the core of the body. However, many core workout appliances are designed to be used for a particular exercise which can necessitate buying and/or keeping a large number of such appliances at home studios or commercial gyms. Accordingly, a core workout fitness apparatus capable of transitioning between more than one conditioning appliance is an unmet need in the art.

SUMMARY

In a first general aspect, an exercise apparatus is disclosed. The exercise apparatus includes an elongate bar, a rolling member including an outer surface and a centrally-located axial aperture that extends through the rolling member, and at least one pair of apertures disposed within the elongate bar, each aperture of the pair of apertures being configured to receive a locking pin. A distance between the at least one pair of apertures is slightly greater than a length of the centrally-located axial aperture, and at least one pair of apertures is disposed entirely on a right or left side of a midpoint of the elongate bar.

In one embodiment, the exercise apparatus further including a second pair of apertures disposed within the elongate bar. The second pair of apertures can be centered on the midpoint of the elongate bar.

In one embodiment, the rolling member is in the shape of a sphere.

In one embodiment, the rolling member further includes a sealable opening for adding additional weight to the rolling member.

In one embodiment, the rolling member further includes a sleeve that extends through the centrally-located axial aperture. The sleeve can have a cross-sectional diameter slightly greater than a cross-sectional diameter of the elongate bar.

In one embodiment, the exercise apparatus further including a grip member disposed only on one side of the elongate bar.

In one embodiment, the roller has a rectangular cross-section when viewed perpendicular to the centrally-located axial aperture.

In one embodiment, the roller has a bow-tie cross section when viewed perpendicular to the centrally-located axial aperture.

In one embodiment, the rolling member is solid and formed of a resilient plastic material.

In one embodiment, the exercise apparatus further includes a removable endpiece to the elongate bar, the removable endpiece having a flared portion and an exteriorly threaded portion, the flared portion having a cross-sectional diameter greater than a cross-sectional diameter of the sleeve. The elongate bar further includes an interiorly threaded end portion complimentary to the exteriorly threaded portion of the removable endpiece.

In a second general aspect, an interchangeable exercise apparatus includes an elongate bar having a plurality of apertures therein that extend through the cross-sectional diameter of the elongate bar, a rolling member, the rolling member including an axial aperture through which the elongate bar is capable of being inserted fully therethrough. The exercise apparatus provides the ability to interchange between a push-up, plank hold or abdominal roll-out bar and a mace.

In one embodiment, the exercise apparatus further includes a plurality of locking pins configured to extend through the elongate bar to keep the rolling member from unintentional shifting along the elongate bar.

In one embodiment, the rolling member is in the shape of a sphere. In a related embodiment, the rolling member further includes a sleeve member extending along the axial aperture.

In one embodiment, the rolling member has an outer cross-sectional diameter of at least six inches.

In one embodiment, to function as the push-up, plank hold or abdominal roll-out bar, the rolling member is positioned at the midpoint of the elongate bar.

In one embodiment, to function as the mace, the rolling member is positioned at or proximal to an end portion of the elongate bar.

In one embodiment, the rolling member is configured to receive additional weight therein.

Certain advantages of the systems and methods include a device that serves as an all-in-one fitness bar that targets the entire body, with greater focus on the core and upper body; an apparatus that can be used as a push-up stand, an ab wheel and is convertible into a mace-like fitness club; the device improves on a balance bar because of the forward and backward rolling direction of the ball whereas traditional balance bars (or boards) only roll side to side. With the addition of a rolling ball, the apparatus can essentially roll in any direction, greatly increasing the functionality of the device; an improvement on traditional push-ups stands due to the inherent instability of the apparatus; increased workout intensity due to the ability of the apparatus to move side to side, forward and backward, and any angle; an improvement on traditional ab wheels which traditionally include of short handles connected to a wheel, wherein the longer bar allows for placement of the hands in a wider stance, making push-ups and planks natural and comfortable; because the apparatus utilizes a ball shape, it can roll out at an angle in a more natural manner; additionally, the bar is able to slide through the ball due to the brass bearing sleeve, it greatly increases the instability of the device, causing more muscles to become engaged to help stabilize the body.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

BRIEF DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
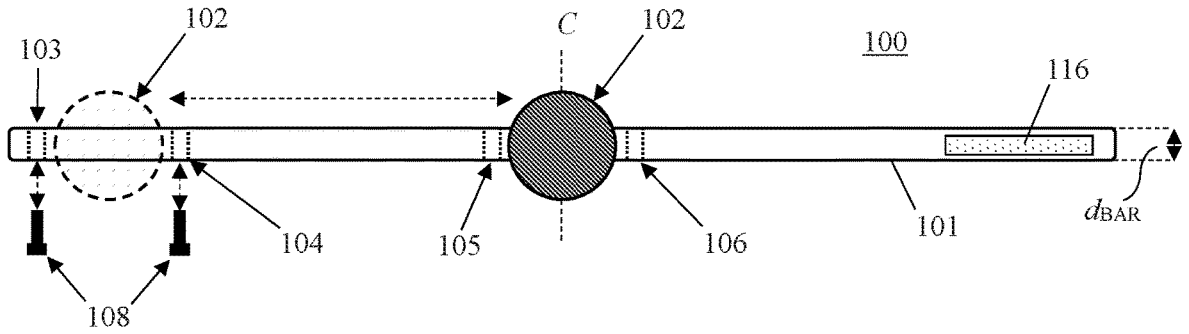
FIG. 1 is an interchangeable fitness apparatus according to one embodiment.

FIG. 1 is an interchangeable fitness apparatus (hereinafter 'apparatus') 100 according to one embodiment. In this embodiment, the apparatus 100 includes a bar 101. In preferred embodiments, bar 101 is formed of a resilient material that resists bending under the weight of a user. Examples include, but are not limited to steel, iron and plastics, with the latter being preferably confined to strong plastics such as polycarbonate. In cases where the bar 101 is iron or steel, the bar may be coated with black oxide, Carakote, zinc or other materials to promote resiliency and reduce wear.

In this embodiment, the bar 101 includes a plurality of apertures 103, 104, 105, 106 that extend through the diameter of the bar 101. In this embodiment, the apertures are arranged in sets of two. In this example, apertures 103 and 104 define a first set, and apertures 105 and 106 define a second set. Each set of apertures is spaced to accommodate a rolling member, in this example, a spherical ball member 102, by being spaced slightly further apart than the cross-sectional diameter of the ball 102, as shown.

Figure 2:
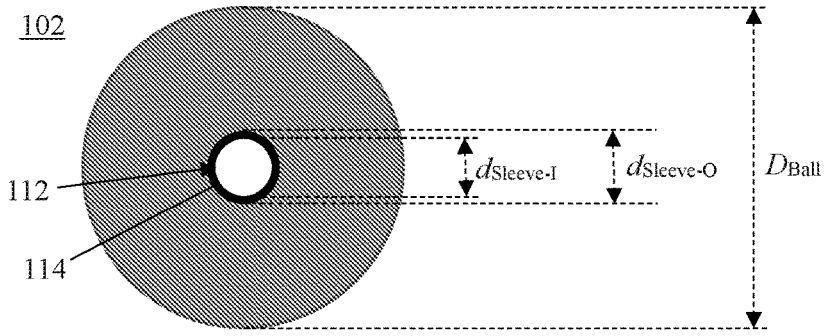
FIG. 2 illustrates a ball portion of the interchangeable fitness apparatus of FIG. 1, according to one embodiment.

Referring to FIG. 2, a cross-sectional elevation view of the ball 102 is shown. In this embodiment, the ball 102 is a solid sphere and formed of a resilient plastic material such as Nylon, polyurethane, high-density polyurethane (HDPE) or other materials. The ball 102 can be of any diameter DBALL however, in a preferred embodiment, the diameter of the ball 102/BALL is six inches. The diameter of the ball can be a factor in using the apparatus 100 according to a preferred workout regimen as explained in greater detail below.

In this embodiment, an aperture 112 bisects the diameter of the ball 102 in a straight line through opposite sides. In a preferred embodiment, a bearing sleeve 114 is attached to the outer diameter surface of the aperture 112. The bearing sleeve preferably has an inner cross-sectional diameter $d_{sleeve\text{-}1}$ equal to, or slightly greater than the cross-sectional diameter of the bar 101 $d_{BAR}$ (FIG. 1). For example, the cross-sectional diameter of the bar $d_{BAR}$ can be 25 mm and the inner cross-sectional diameter $d_{sleeve\text{-}1}$ of the bearing sleeve 114 can be 25.4 mm.

In a preferred embodiment, the bearing sleeve 114 can have a thickness of about 2.3 mm, although other thicknesses may be substituted.

Referring back to FIG. 1, in this embodiment, the bar 101 can be fed through the aperture 112 of the ball 102, allowing the ball to slide along the length of the bar 101 as indicated by the dashed double arrow. The ball 102 can be held in a preferred location on the bar 101 using a pair of quick release pins 108 inserted into selected apertures, e.g., apertures 105 and 106 or 103 and 104. It should be understood that the positions of the apertures 103, 104, 105, 106 are exemplary and that the bar 101 can accommodate more or fewer apertures according to preference.

The apparatus 100 can be used to facilitate a number of different exercises, in particular, core exercises. For example, referring to FIG. 3, the apparatus 100 can be used in performing core exercises such as push-ups, plank holds and abdominal roll outs. In use, the user can place the ball 102 at a desired location on the bar 101 according to the type of exercise that will be performed. In the example of push-ups, plank holds and abdominal roll outs, the user may elect to place the ball 102 in the center of the bar 101. The user can elect to keep the ball 102 centered on the bar 101 through the use of the quick release pins 108 which confines the lateral movement of the ball between, e.g., apertures 105 and 106.

The apparatus 100 can facilitate greater core exercising than performing the same exercises without the apparatus. For example, when using the apparatus 100 to perform push ups as shown, the user uses more of the target muscles (or integrates accessory muscles) to keep his arms from shifting forward or backward. Similarly, the user improves strength, coordination and balance by keeping his body square to the bar 101, e.g., not tilting to one side.

To perform abdominal roll outs, the user may assume a push-up configuration and, while keeping his arms straight, pushes the apparatus 100 away from him a desired distance, then returns the apparatus 100 to the original location. Again, the apparatus aids in building core strength, balance and coordination as the user attempts to keep the bar 101 level and the ball 102 rolling smoothly back and forth, e.g., along the indicated dashed line in FIG. 3.

In this embodiment, the apparatus 100 is interchangeable so as to facilitate performing different exercises. For example, the apparatus 100 can be interchanged from the appliance used to perform push-ups, plank holds and abdominal roll outs previously described, to a mace. In this embodiment, to interchange the apparatus 100, the user would position the ball 102 at the end of the bar 101. It should be understood that if the apparatus 100 is in the configuration shown in FIG. 3, the quick-release pins 108 would first be removed, then the ball 102 can be slid down the bar 101 until the ball 102 is positioned between the apertures 103, 104 at the end portion of the bar 101. At this point, the quick release pins 108 would be inserted into the aperture 103, 104 to keep the ball 102 in place at the end of the bar 101.

To facilitate exercising with the apparatus 100 configured as a mace (e.g., as shown in FIG. 1 where the ball 102 has been slid from the center C of the bar 101 to the left-hand side of the bar as shown in dashed line), the bar 101 can optionally include one or more grips 116. The grips may be positioned where a user would naturally hold the apparatus to perform certain exercises; for example, a mace grip 116 can be incorporated on the right of the bar as shown. Grips may also be used on either side of the ball 102 when performing push-up, plank holds and abdominal roll outs; however, to avoid interference with the sliding action of the ball 102, it can be preferred to use grips capable of being easily attached and detached when using the ball 102 in the center C of the bar 101.

In this and other embodiments, the ball 102 portion of the apparatus 100 can be interchanged with different types and shapes of rollers to facilitate different—or greater or lesser core strength training. For example, in the embodiment of FIG. 1, the ball 102 is in the shape of a sphere which can require the most balance and coordination while performing exercises such as push-ups, plank holds and abdominal roll outs. This is because as the sphere rolls, a narrow strip portion along the circumference of the sphere is the only part that contacts the ground.

Figure 3:
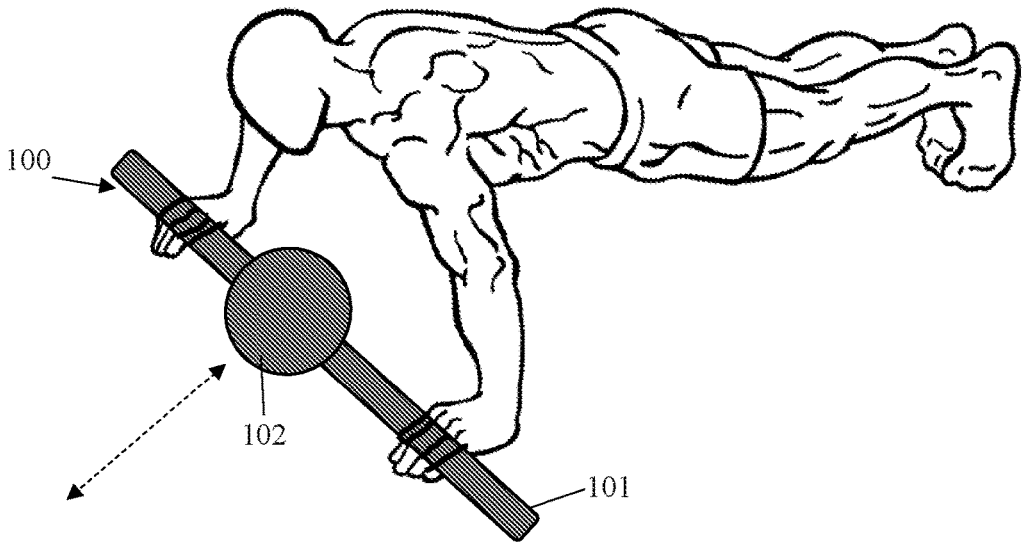
FIG. 3 illustrates a interchangeable fitness apparatus in use according to one embodiment.
Figure 4A:
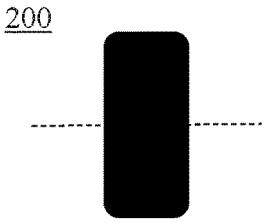
FIGS. 4A and 4B show alternative embodiments of rollers to be used with the interchangeable fitness apparatus.
Figure 4B:
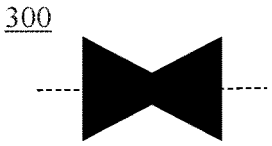

Referring now to FIGS. 4A and 4B, alternatives to the ball 102 shown in FIGS. 1-3 are shown in cross-sectional form. In these examples, the dashed line bisecting the ball alternatives represents the rolling axis, e.g., the axis through which the aperture is located and through which the bar 101 is inserted. In this example, the roller 200 depicted in FIG. 4A can provide additional surface area on which the roller can roll, thereby decreasing the strength, balance and coordination required when using ball 102. Similarly, FIG. 4B shows another embodiment of a roller 300, whereby the roller contacts the ground at two points, i.e., the left and right sides. Roller 300 can be considered an intermediate in difficulty between the roller shown in FIG. 4A and ball 102.

Figure 5:
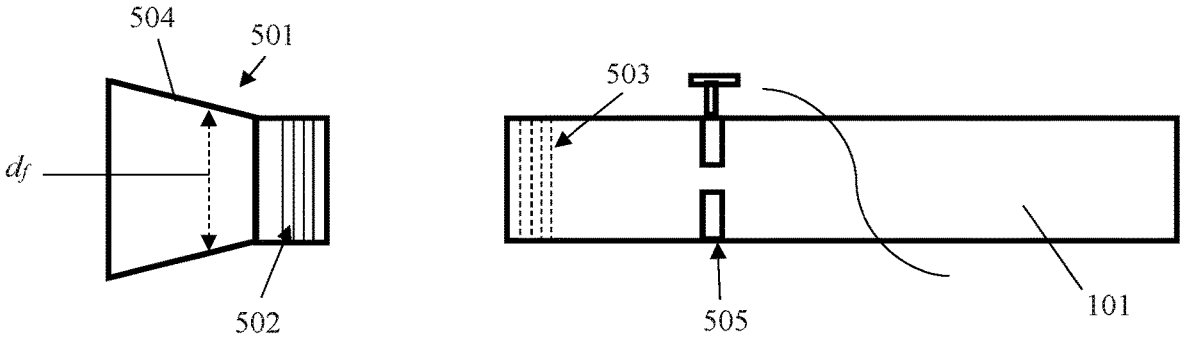
FIG. 5 illustrates a removable endpiece to an interchangeable fitness apparatus according to one embodiment.

Referring now to FIG. 5, in one embodiment, the apparatus 100 can include a removable endpiece 501 to the bar 101. In this example, the endpiece 501 includes a threaded portion 502 and a flared portion 504. In this example, the threaded portion 502 has exterior threads that are complimentary to an interiorly threaded portion 503 on a terminal end portion of the bar 101 as illustrated. The flared portion 504 has a cross-sectional diameter de that is greater than the inner diameter $d_{sleeve\text{-}1}$ of the bearing sleeve 114 so that the ball 102 is prevented from escaping the end of the bar 101 having the endpiece 501 installed. In this embodiment, the threaded endpiece allows a user to utilize the apparatus 100 in the mace configuration with a secure attachment that keeps the ball 102 from escaping the bar 101 during exercise.

Still referring to FIG. 5, in this and other embodiments, one or more clamp members 505 can be used as alternative to the quick-release pins 108. In this example, one or more clamp members 505 can be placed anywhere along the length of the bar 101, for example, on left and right sides of the ball 102 to prevent the ball 102 from sliding along the length of the bar 101. The clamp member 505 can include a quick-release mechanism to allow it to be easily and quickly attached and detached from the bar 101 by a user.

In these and other embodiments, ball 102 or any roller (e.g, roller 200, 300) can be weighted. In an example accomplishing this feature, ball 102 or any roller can be formed to be hollow with a sealable opening designed to allow substances to be introduced therein. Example substances include, without limitation, sand, water, weights and other materials. Accordingly, the difficulty of exercises and strength training can be adjusted according to preference, especially when using the apparatus 100 in the mace configuration.

A number of illustrative embodiments have been described. Nevertheless, it will be understood that various modifications may be made without departing from the spirit and scope of the various embodiments presented herein. Accordingly, other embodiments are within the scope of the following claims.

What is claimed is:

1. An exercise apparatus, comprising:

an elongate bar;

a rolling member comprising an outer surface and a centrally-located axial aperture that extends through said rolling member;

at least one pair of apertures disposed within said elongate bar, each aperture of said pair of apertures being configured to receive a locking pin;

wherein a distance between said at least one pair of apertures is slightly greater than a length of said centrally-located axial aperture; and wherein said at least one pair of apertures is disposed entirely on a right or left side of a midpoint of said wherein said at least one pair of apertures comprises a first pair and a second pair of apertures disposed within said elongated bar; and wherein said second pair of apertures is centered on a midpoint of said elongated bar.

2. The exercise apparatus of claim 1, wherein said rolling member is in a shape of a sphere.

3. The exercise apparatus of claim 1, wherein said rolling member further comprises a sealable opening for adding weight to said rolling member.

4. The exercise apparatus of claim 1, wherein said rolling member further comprises a sleeve that extends through said centrally-located axial aperture.

5. The exercise apparatus of claim 4, wherein said sleeve has a cross-sectional diameter slightly greater than a cross-sectional diameter of said elongate bar.

6. The exercise apparatus of claim 1, further comprising a grip member disposed only on one side of said elongate bar.

7. The exercise apparatus of claim 1, wherein said roller has a rectangular cross-section when viewed perpendicular to said centrally-located axial aperture.

8. The exercise apparatus of claim 1, wherein said roller has a bow-tie cross section when viewed perpendicular to said centrally-located axial aperture.

9. The exercise apparatus of claim 1, wherein said rolling member is solid and formed of a resilient plastic material.

10. The exercise apparatus of claim 1, further comprising:

a removable endpiece coupled to said elongate bar, said removable endpiece having a flared portion and an exteriorly threaded portion, said flared portion having a cross-sectional diameter greater than a cross-sectional diameter of a sleeve; and wherein said elongate bar further comprises an interiorly threaded end portion complimentary to said exteriorly threaded portion of said removable endpiece.

11. An interchangeable exercise apparatus, comprising:

an elongate bar having a plurality of apertures therein that extend through the cross-sectional diameter of said elongate bar, wherein said plurality of apertures are configured to receive a locking pin;

a rolling member, said rolling member comprising an axial aperture through which said elongate bar is capable of being inserted fully therethrough;

wherein said exercise apparatus provides the ability to interchange between a push-up, plank hold or abdominal roll-out bar and a wherein said plurality of apertures comprise a first pair and a second pair of apertures disposed within said elongate bar, wherein said second pair of apertures is centered on a midpoint of said elongated bar.

12. The exercise apparatus of claim 11, further comprising a plurality of locking pins configured to extend through said elongate bar to keep said rolling member from unintentional shifting along said elongate bar.

13. The exercise apparatus of claim 11, wherein said rolling member is in a shape of a sphere.

14. The exercise apparatus of claim 13, wherein said rolling member further comprises a sleeve member extending along said axial aperture.

15. The exercise apparatus of claim 11, wherein said rolling member has an outer cross-sectional diameter of at least six inches.

16. The exercise apparatus of claim 11, wherein to function as said push-up, plank hold or abdominal roll-out bar, said rolling member is positioned at the midpoint of said elongate bar.

17. The exercise apparatus of claim 11, wherein to function as said mace, said rolling member is positioned at or proximal to an end portion of said elongate bar.

18. The exercise apparatus of claim 11, wherein said rolling member is configured to receive weight therein.

* * * * *